United States Patent [19]

Vanhatalo et al.

[11] Patent Number: 5,053,239

[45] Date of Patent: Oct. 1, 1991

[54] PROCESS AND APPARATUS FOR PRODUCING A PACKAGED SAUSAGE PRODUCT AND THE PACKAGED SAUSAGE PRODUCT THEREBY

[75] Inventors: Pentti J. Vanhatalo; Visa A. P. Krappe, both of Pori, Finland

[73] Assignee: Food Systems Industries Oy, Ltd., Finland

[21] Appl. No.: 548,959

[22] PCT Filed: Jan. 27, 1989

[86] PCT No.: PCT/FI89/00016

§ 371 Date: Jul. 27, 1990

§ 102(e) Date: Jul. 27, 1990

[87] PCT Pub. No.: WO89/07074

PCT Pub. Date: Aug. 10, 1989

[30] Foreign Application Priority Data

Jan. 28, 1988 [FI] Finland ..... 880382

[51] Int. Cl.[5] ..... A23B 4/00; B65B 9/00

[52] U.S. Cl. ..... 426/412; 53/440; 53/450; 53/453; 426/113; 426/129; 426/414; 426/513

[58] Field of Search ..... 426/412, 413, 414, 129, 426/113, 105, 135, 513; 53/450, 453, 553, 440, 127, 122

[56] References Cited

U.S. PATENT DOCUMENTS

| | | | |
|---|---|---|---|
| 2,828,590 | 4/1958 | Swarta et al. | 53/450 |
| 3,355,854 | 12/1967 | Lowry | 53/451 |
| 3,495,992 | 2/1970 | DeFor | 426/412 |
| 3,498,019 | 3/1970 | Rait | 53/450 |
| 3,596,428 | 8/1971 | Young et al. | 53/451 |
| 3,751,202 | 8/1973 | Coleman et al. | 425/133 |
| 3,752,618 | 8/1973 | Moreland | 425/133 |
| 4,015,021 | 3/1977 | Harima et al. | 426/413 |
| 4,293,979 | 10/1981 | Colosimo et al. | 17/32 |
| 4,379,356 | 4/1983 | Geissbühler | 17/45 |
| 4,404,229 | 9/1983 | Treharne | 426/513 |
| 4,437,206 | 3/1984 | Becker | 17/1 F |
| 4,601,929 | 7/1986 | Erk et al. | 426/129 |
| 4,623,566 | 11/1986 | Kastl et al. | 426/105 |

FOREIGN PATENT DOCUMENTS

| | | | |
|---|---|---|---|
| 2365159 | 7/1975 | Fed. Rep. of Germany | 426/105 |
| 2515067 | 11/1976 | Fed. Rep. of Germany . | |
| 2945475A1 | 5/1981 | Fed. Rep. of Germany . | |
| 7716772 | 12/1978 | France . | |
| 1271214 | 4/1972 | United Kingdom . | |

*Primary Examiner*—George Yeung

*Attorney, Agent, or Firm*—Merchant & Gould, Smith, Edell, Welter & Schmidt

[57] ABSTRACT

The invention relates to a process and apparatus for producing a sausage package containing up to about 30 sausages wherein each sausage is individually packaged in packaging films. The sausages are produced directly into the packaging films to be cooked while being retained within said films. Suitable sized packages including one or more sausages may be cut from the length of packaging film including the individual sausages. The unique possibility of producing several parallel sausages is obtained by sealing off the individual sausages from continuous parallel packaging film tube by sealing and shaping molds forming the rear end of one stuffed row of sausages and the fore end of the next row of sausages to be stuffed.

20 Claims, 2 Drawing Sheets

Figure 1:
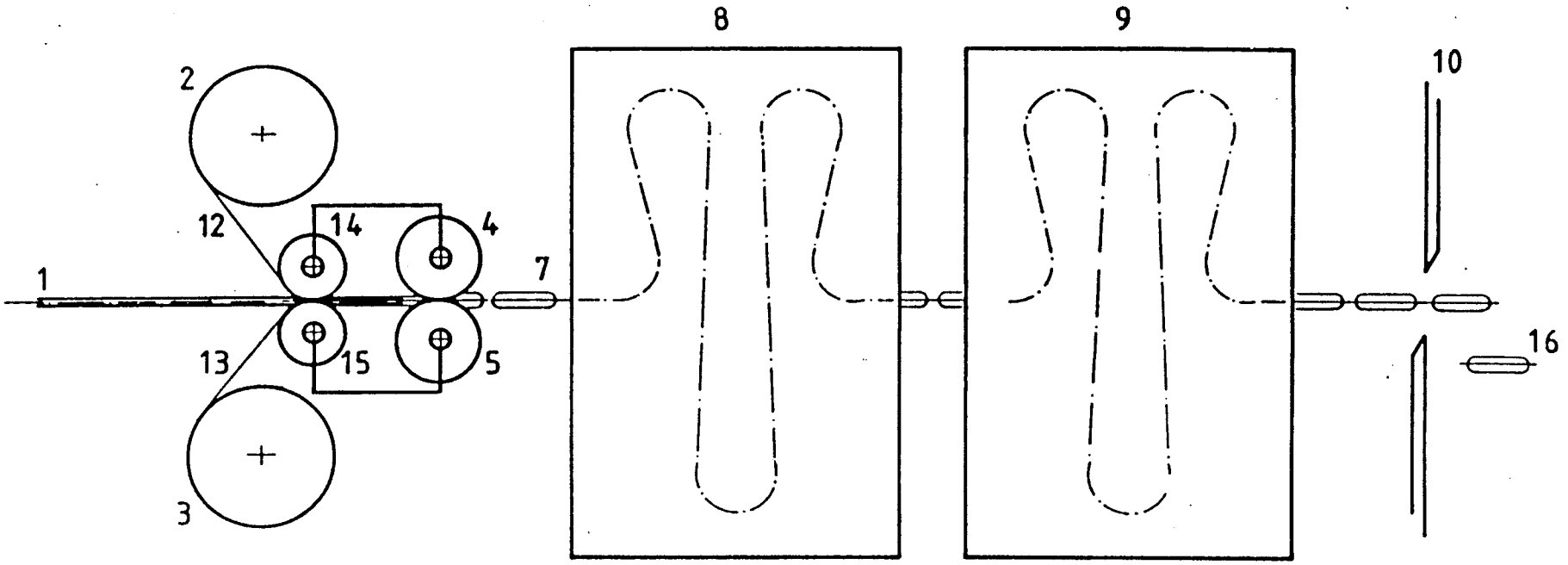

PROCESS AND APPARATUS FOR PRODUCING A PACKAGED SAUSAGE PRODUCT AND THE PACKAGED SAUSAGE PRODUCT THEREBY

The invention relates to a process for producing a packaged sausage product comprising one or more individually packaged sausages which are produced directly into the packaging films and are cooked while being retained within said films. The invention also relates to an apparatus for producing said packaged sausage products and to the products so formed.

The products of the invention are preferably frankfurter type sausages (Frankfurter, Wiener, Sosisky, etc.) or larger size sausages formed as packaged products. The packages are preferably in a form directly suitable for retail sale.

In the conventional production of sausages the sausage emulsion is stuffed into a tubular casing which is either a natural casing or a synthetic casing produced of cellulose, protein or plastic. The size of the preformed tubular casing determines the diameter of the sausage and the desired sausage lengths are clipped and cut or linked from the long tubular casing.

It has also been suggested to produce the sausage casing simultaneously with the sausage itself by forming a casing around the sausage being produced. Such solutions are disclosed e.g. in U.S. Pat. Nos. 3,751,202, 3,752,618 and 4,404,229.

Since, however, the sausage casing is often removed from the food product prior to eating, more and more sausages have recently been marketed without any surrounding skin. Skinless sausages are generally produced by stuffing sausage emulsion into a conventional tubular casing which may be technically more durable than conventional casings, and peeling the casing off the sausage after the cooking stage. The casing is thereafter discarded. U.S. Pat. No. 4,437,206, on the other hand, suggests the use of a reusable casing in the production of skinless sausages.

During the cooking stage a darker area is formed at the periphery of the sausages when the sausage emulsion coagulates under the temporary skin, and when peeled the sausage looks in the eyes of the consumer as if it had a kind of skin. After the cooking stage comes the laborious peeling stage and the expensive casing, which at present forms up to one fifth of the costs for the materials of the product, must be removed and discarded. The peeled skinless sausages are generally packaged hygienically into a form and size suitable for retail sale, ordinarily by using vacuum packaging techniques.

It has also been suggested to produce skinless sausages totally without any skin, as for example in the way disclosed in U.S. Pat. No. 4,293,979 by extruding the meat emulsion into long ribbons, freezing the ribbons and cutting the frozen and dimensionally stabilized ribbons into suitable sausage sized pieces; as disclosed in DE Patent Application 25 15 067 by heating the surface of an extruded rod so that the surface protein coagulates into a kind of seeming skin; or as disclosed in U.S. Pat. No. 4,379,356 by casting the meat emulsion into a mold, heating it in the mold until the protein coagulates and removing the molded product from the mold, after which the mold is cleaned and can be used again. The skinless meat or sausage products are then packaged in the conventional way such as into vacuum packages suitable for retail sale.

The skinless production of sausages by the above described methods requires a lot of special equipment and a separate packaging stage cannot be avoided.

U.S. Pat. No. 3,495,992 discloses a method wherein frankfurter type sausages are produced directly into packaging films. The solution according to said Patent suggests forming empty sausage-like cells by sealing together preformed packaging films and filling said cells with sausage emulsion by puncturing a wall of the film cell and dispensing sausage emulsion into the cell. The Patent then suggests closing the punctured opening of the stuffed cell by heat sealing. Since, however, the closing of an opening in the film of a stuffed cell in the presence of fatty sausage emulsion by heat sealing or by any other means is next to impossible and in any case an extremely uncertain operation, the process suggested by the Patent has not found favour in practice.

The present invention avoids the disadvantages of the prior art by a process wherein the sausages are successfully produced directly into the packaging films. The final sausage can be molded and treated while being retained between said packaging films. Thus "skinless" sausage products can be produced directly into the final packages without any separate peeling and packaging stage.

In the production of the skinless sausages of the invention the use of a separate expensive casing material is avoided and no extra peeling stage is required. In the production of frankfurter type sausages the invention provides for a saving in avoiding the requirement of linking, peeling, sorting and separate packaging and achieves a finished sausage product without the conventionally used machines for each of said stages.

Also in the production of larger sized sausages the advantages of the invention are evident to those skilled in the art. Further, sausages which are meant to be sliced can be molded into a form which more resembles the ideal straight cylinder so that the product losses due to the rounded ends of conventional sausages are minimized at slicing. In the production of large sized sausages the clipping machines also become superfluous.

Since the sausages are produced directly into tightly sealed packages for sale, no separate packaging machines are required and due to the closed and short process arrangement the product is safely and hygienically packaged into the final packaging films early in the production and prior to the cooking stage. By closing the sausage emulsion tightly into a sealed pocket already at the initial stage of the overall production process the weight losses during finishing are also minimized. This is especially valuable in the production of cooked sausages the weight losses of which may be considerable in conventional processes.

The process of the invention requires a relatively small space and it is well suited for automatization. The process is not either tied to any specific sausage composition or finishing treatment and it is extremely flexible as to the size and form of the sausages to be produced.

The object of the invention is thus to provide a sausage product packaged for sale wherein the sausage has the desired form and stability and wherein the sausage comprises no other skin except the packaging films.

Another object of the invention is to provide a process for producing a sausage directly into the final package.

It is also an object of the invention to provide an apparatus for producing a sausage directly into the final package. According to the preferred embodiment of the invention the sausage is a "skinless" frankfurter type sausage.

The detailed objects and characteristics of the invention will be made clear in the following specification and claims.

Accordingly the invention relates to a process for producing a sausage package containing one or more sausages wherein each sausage is individually packaged in packaging films, in which process the sausages are produced directly into the packaging films and are cooked while being retained within said films. Packages including one or more sausages may be cut from the length of packaging film including the individual sausages. Said process is characterized in that discrete portions of sausage emulsion are stuffed between advancing packaging films through at least one stuffing horn extending in the direction of the movement of said films, said packaging films being continuously and longitudinally sealed on both sides of said stuffing horn to form a continuous film tube having essentially the desired sausage diameter, and said film tube is transversely flattened between the portions of stuffed sausage emulsion by a molding means molding the respective ends of the sausages and sealing together the tube forming films, and the molded sausages sealed within individual film pockets are removed from the mold for further treatment.

Although the invention is very well applicable to producing packages of single sausages cut from the continuous string of packaged sausages the greatest advantages of the invention lie in the fact that several parallel sausages can be produced simultaneously. This is a unique capability which is not possible in the conventional clipping and linking methods.

In the preferred embodiment of the invention there thus is provided a process for producing a package including several parallel individually packaged sausages in which process continuously advancing packaging films are sealed on both sides of each of several, e.g. 3 to 20 individual parallel stuffing horns to form as many connected parallel packaging film tubes, and said discrete portions of sausage emulsion are intermittently stuffed into said film tubes in such a way that the continuously advancing film tubes become essentially filled with sausage emulsion along a path corresponding to the length of one sausage at a time, and the open ends of the film tubes are synchronously flattened, molded and sealed by a molding means between said portions of sausage emulsion in those areas of said film tubes which are devoid of sausage emulsion.

The rear end of one row of sausages and the fore end of the next row of sausages are preferably molded by said molding means in the same molding operation in such a way that said next row of sausages will be stuffed into the open ends of film tubes which are closed at the opposite ends.

The invention also relates to a sausage package containing one or more sausages, wherein each sausage is enclosed in a sealed pocket of packaging films, within which pocket said sausage is cooked to a more stable form during the production thereof. Suitably sized packages may be cut from a length of packaging film containing several parallel individually packaged sausages. The package of the invention is characterized in that each individual sausage in said package is enclosed in a pocket formed of a continuous tube of longitudinally sealed packaging films which tube is transversely flattened and sealed between the individual sausages by a sausage end molding means.

For the proper sealing of the space between the individual sausages it is preferred that the areas between the successively produced individual sausages in said package are devoid of sausage emulsion and are flattened and sealed by a molding means molding the rear end of one sausage and the fore end of the next sausage.

The package preferably comprises a packaged product ready for sale, such as a retail sale package including one or more multiples of the length and/or the breadth of a sausage, which package is cut from a product mat of continuous lengths of packaging films with individually packaged sausages.

The invention further relates to an apparatus for producing individually packaged sausage products directly into packaging films, said apparatus comprising at least one stuffing horn;

means for advancing continuous packaging films in the direction of said stuffing horn on opposite sides thereof;

means for continuously sealing said packaging films longitudinally on two sides of said stuffing horn to form a film tube having essentially the diameter of a sausage;

means for stuffing discrete portions of sausage emulsion into said film tube; and molding means for transversely flattening said film tube and sealing the packaging films together between the sausage emulsion portions to form the desired sausage end configuration.

Preferably said apparatus comprises several individual parallel stuffing horns and means for sealing the continuously advancing packaging films on two sides of each stuffing horn. The stuffing means are adapted to intermittently stuff sausage emulsion into each continuously advancing film tube so that each film tube is essentially filled with sausage emulsion along the path corresponding to one sausage at a time. The molding means is preferably adapted to synchronously mold the ends of the film tubes into the desired form of the sausage ends by flattening and sealing the films together between said sausage emulsion portions at the areas of the film tubes which are devoid of sausage mass.

Figure 2:
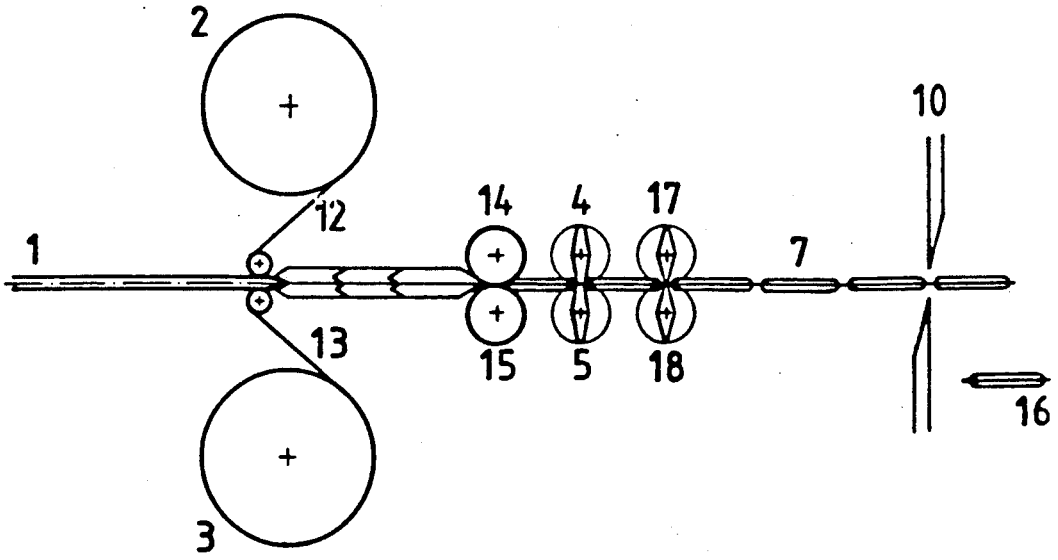
Figure 3:
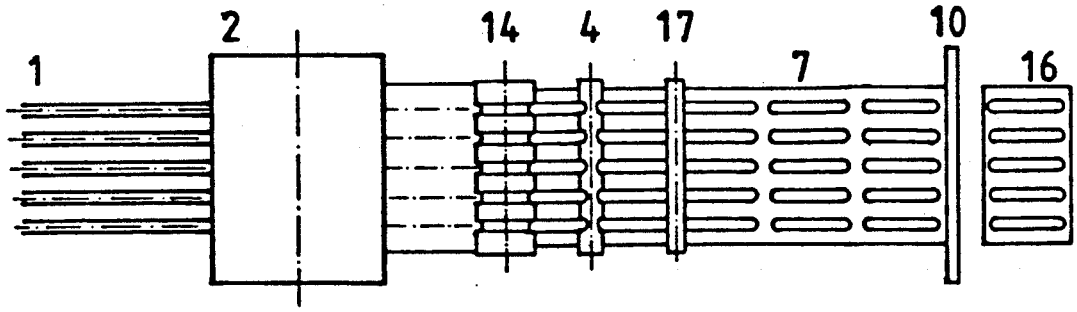

The invention is described in more detail in the following specifications and exemplified in the drawings, wherein FIG. 1 shows a schematic side view of the equipment according to one embodiment of the invention indicating the working principle of the invention;

FIG. 2 shows a schematic side view of the preferred embodiment of the invention; and FIG. 3 shows the equipment of FIG. 2 from another side.

The invention will now be described by referring to the drawings. FIG. 1 shows a stuffing horn connected to a means (not shown) for stuffing sausage emulsion. Said stuffing horn 1 extends between continuous packaging films 12, 13 which are unrolled from rolls 2, 3 mounted on opposite sides of said stuffing horn. In the depicted embodiment the sausage emulsion is fed in a horizontal direction but it is evident that in practice the sausage emulsion may also be fed in the vertical direction downwards. It is also evident that the upper and lower films 12, 13 may be fed from one source by folding the film.

On opposite sides of the advancing films 12, 13 are provided sealing cylinders 14 and 15, respectively, which are in a continuous contact with the advancing films on both sides of the stuffing horn 1 for longitudinally sealing the packaging films together into a film tube having essentially the diameter of the desired sausage. The outer diameter of the stuffing horn 1 may correspond to the diameter of the sausage to be produced or it may be smaller. The sealing cylinders are designed to allow the stuffing horn 1 and the tube forming film to pass freely out of contact with the surface of the cylinder. This may be accomplished by peripheral grooves, cut-away portions in the cylinders or the like.

The contacting surfaces of at least one of the sealing cylinders may be formed as heating surfaces which continuously heat seal the films together on both sides of the stuffing horn to form said continuous film tube. It is evident, however, that the sealing may also be performed in another way, such as for example by glueing the two films together.

The packaging films are made to move continuously forward in the direction of the extension of the stuffing horn by the pulling motion of the sealing cylinders 14, 15 or by the action of any of the subsequent operations, or both.

Close to the discharge end of the stuffing horn 1 sausage end molding means are provided transversely to the direction of movement of the packaging films. The molding means are preferably formed as rotating molds 4 and 5, stretching across the advancing film tubes, one on each side of said films. The molds are mounted essentially parallel with the sealing cylinders 14, 15 so that their axis of rotation is essentially perpendicular to the advancing movement of the films.

The molds are designed for synchronous operation with the stuffing in such a way that as the stuffing means stuff sausage emulsion into the advancing film tube the stuffed tube is allowed to pass freely out of contact with the rotating molds 4 and 5 along a path corresponding to the length of one sausage. As the stuffing stops the tube is flattened by the molding parts of the molds having rotated into a position where contact is made with the film, and the end of the sausage is molded. The molding parts of said molds 4 and 5 have rounded surfaces adapted to come into pressing contact with the film tube on opposite sides thereof to flatten the tube and to mold the desired configuration of the sausage end. In a rolling motion the molds are designed to mold the rear end of one sausage and the fore end of the next sausage and a flattened space therebetween. The operation thus produces sausage products individually enclosed in sealed pockets of packaging film, in which pockets the form of the sausage is retained throughout the subsequent treatment.

Sealing means (not separately shown) are connected with at least one of the molding parts of the said molds 4, 5 for sealing the packaging films together at the flattened area. The sealing means may comprise a heated surface in at least one of the molding parts for heat sealing the packaging films. Alternatively the sealing may be Performed by glueing or by any other suitable means which forms a tightly sealed film pocket wherein the form of the product is retained.

In the production of skinless frankfurter type sausages the form of the molding surface is advantageously such that both ends of the rounded surface have half-circle shaped molding recesses so that the fore and the rear end, respectively, of the sausage is provided with the conventional rounded and slightly "wrinkled" appearance that the consumer as accustomed to. Correspondingly the ends of larger sized sausages can be molded into a less rounded form so that cutting losses are minimized at slicing. At the molding stage it may be advantageous to use vacuum in the mold for drawing the packaging films closely to the molding surfaces especially in the case that less rounded ends are to be molded.

It is also possible to use molding means of another type instead of the present preferred rotating molds. Thus it is possible within the scope of the invention to provide the flattening, molding and sealing operation by molding means formed of two opposite molding parts which move into pressing contact with ,the advancing film tube synchronously with the end molding requirement and move out of said contact for the time required for the stuffed sausage portion to move past the mold. Thus it is possible to "stamp" sausage ends into the empty spaces of a continuous tube being filled with discrete spaced portions of sausage emulsion.

The molds are adapted to remove the molded sausages from the mold by the rolling motion thereof. The outer parts of the molds may be cylindrical and engage the longitudinally sealed seams of the packaging films in a rolling contact for orienting the films and for advancing the molded sausage products. As the molded sausage is removed from the mold the sausage emulsion for the next sausage is synchronously stuffed into the open end cf the film tube which is formed by the sealing cylinders 14, 15 and which is sealed at the fore end by the molds 4, 5.

The molded sausages are enclosed in individual sealed pockets of packaging film interconnected by the flattened parts of the continuous film. Thus is formed a continuous product mat 7 with individually packaged sausages. The produced product mat can thereafter be treated in any desired way.

The strength of the product mat 7 is generally sufficient for carrying its own weight but in certain oases, especially when large products are in question it may be advantageous to support the product mat for example by conveyor belts, rolls or the like.

In FIG. 1 there are schematically indicated post treatment departments 8 and 9 for the finishing treatment of the product. In the indicated process the product is led into the post treatment operation in a continuous length, but it is obvious to those skilled in the art that the continuous length may be cut into suitable sized pieces also prior to the post treatment operation.

In FIG. 1 the product mat 7 is led to the cooking chamber 8 wherein the sausage emulsion enclosed in the pocket of packaging films is cooked to a more stable form by the heat delivered by a medium, such as water or steam, the heating parameters of which are controlled in relation to the surroundings. The heating may be performed also in other ways such as by micro wave heating.

After the cooking the product mat 7 is preferably directed into a cooling chamber 9, wherein the products are effectively cooled in a controlled way until the desired cooled temperature of the product is obtained. The cooling medium preferably comprises water, saline water and/or air circulation. By such an intensive cooling the product being continuously advanced through the cooling chamber is very quickly cooled. The intensive cooling improves the keeping quality of the product and the product may keep as much as three times longer than a conventionally cooled product.

When the product mat 7 is discharged from the cooling chamber 9 of FIG. 1 it passes via a cutter 10 cutting suitable sized packages from the continuous product mat 7. The cutting may be performed transversely and/or longitudinally. The packages may be packages 16 suitable for retail sale which contain one or more multiples of sausage units. The cutting of the film is preferably performed so that the cut edge has a saw-like configuration in order to facilitate the opening of the package by tearing. Alternatively the edge of the package may be provided with tearing slits at the end of each individual sausage. Stamping means for stamping dates, etc. may be provided.

In case the sealing is performed by glueing the glue should be one that will hold tightly during the treatment of the sausage but will allow the opening of the package be tearing the two films apart. The glued package should preferably be provided with an unglued part to facilitate the tearing apart of the packaging films.

The preferred embodiment of the invention is shown in FIGS. 2 and 3 wherein the reference numerals for similar objects are the same as in FIG. 1. The preferred apparatus comprises several individual parallel stuffing horns for feeding sausage emulsion between continuously advancing packaging films 12 and 13 being unrolled from rolls 2 and 3, respectively, on opposite sides of the stuffing horns. For the production of frankfurter type sausages it is preferred to have about 3 to 20, preferably about 5 to 10 parallel stuffing horns.

The tension of the packaging films as they are unrolled from rolls 2, 3 is preferably continuously adjusted by tension adjusting means (not shown) which are conventional in the art. It is also preferable to control the direction of the packaging films e g. by film orienting means schematically indicated in FIG. 2 by arrow-like signs < and in FIG. 3 by broken lines.

In the preferred embodiment sausage emulsion is intermittently fed vertically downwards into the parallel film tubes being continuously formed by the sealing cylinders 14, 15 which seal the packaging films on two sides of each of the stuffing horns 1. Feeding the sausage emulsion in the vertical direction facilitates the proper filling of the film tube and also ensures that the space between the stuffed portions remain essentially free of sausage emulsion as the stuffing stops. This ensures that the sealing between the discrete sausages will not be disturbed by the presence of fatty sausage emulsion.

Adjacent the discharge end of the stuffing horns 1 the sausage end molding means 4, 5 stretch transversely across the packaging films one on each side of the advancing films. The molding means are preferably formed of two bars 4 and 5, respectively, arranged for rotation around their longitudinal axis. The ends of said bars are provided with rounded sausage end shaping surfaces for molding the sausage ends at positions corresponding to the individual stuffing horns. Said rounded surfaces include recesses corresponding to the desired shape of the sausage ends. Alternatively the molds may be formed as triangular molds with three molding surfaces or separate molds may be used for molding the ends of each of the sausages separately and simultaneously. Cylindrical and peripherally grooved molds and other kinds of molds may also be used.

The molds 4 and 5 are arranged for synchronous rotation with the stuffing in order to flatten and seal the tubes at the intervals coinciding with the areas free of sausage emulsion, thus molding the rear ends of the row of stuffed sausage. In the same molding operation the molds are designed to roll on and flatten and seal a portion between the individual consecutive sausages and also to mold the fore end of the next row of sausages. For the purpose of the invention the actual form of the molding means is not critical since it is important only that the end molding parts of the molds are designed to provide the desired form of the sausage ends and the flattened spaces between the sausages.

It is the use of a mold for sealing off the individual sausages which provides for the unique possibility of the invention to produce several parallel sausages simultaneously.

The molds 4, 5 may be provided with cylindrical portions adapted to rotate in essentially continuous contact with the longitudinally sealed seams of the film tubes and thus to assist in orienting the films and moving the molded sausages onward from the mold. The molded product being discharged from the mold comprises a continuous product mat 7 with several parallel individually packaged sausages in a continuous string. The product mat 7 can thereafter be treated in any desired way such as the treatment described above in connection with FIG. 1.

The embodiment of FIG. 3 further shows a means 17, 18 for cutting tearing slits in the flattened parts of the film tubes at positions corresponding to an end of each sausage. The product mat may also be transversely and/or longitudinally cut by a cutter in connection with the slit cutting means prior to the post treatment or at any other stage of the treatment. For the retail sale of frankfurter type sausages it is suitable to form packages containing from about 3 to about 30 sausages in one package. This can be accomplished by producing about 3 to 20 parallel sausages with 1 to about 5 consecutive rows in a package. Alternatively the product mat 7 may be rolled onto a reel in long strings suitable for larger households, restaurants etc. This is true especially for the product wherein the pocket is formed by glueing and may be opened by hand or even automatically be tearing the two films apart.

The packaging films that can be used in the practice of the invention are any suitable tightly sealable film material which can be sealed by heat sealing, glueing or any other suitable means and which is compatible with the food product. The film should also withstand the production conditions without being deformed or distorted. The packaging film which is preferably used comprises an air impermeable, heat sealable polymer film from which the pockets can be formed by air tightly heat sealing the films around the sausages. Suitable films are for example heat sealable polymer based laminate films such as polyamide-polyethylene films. The film is preferably an air impermeable oriented and unstretching plastic film.

The recipe of the sausage emulsion as such has no essential impact on the performance of the process. It should be noted, however, that since the product is enclosed within an air tight film it is not possible to smoke the sausages in the conventional way. The smoking flavor ca n, however, be imparted to the product by adding smoking flavor, such as liquid smoke to the recipe. The packaging films may also be coated with substances which facilitate the peeling of the packaging films from the product, such peeling aids being known to those skilled in the art.

The invention has now been described especially with a reference to the preferred embodiment of producing several parallel "skinless" frankfurter type sausages. To those skilled in the art it will, however, be evident that the invention can be applied to the production of larger sized sausages as well as to the production of other kinds of proteinaceous moldable products which are heated to a more stable form subsequent to the molding.

We claim:

1. A process for producing sausages, wherein several parallel frankfurter type sausages are stuffed simultaneously, said process comprising the steps of continuously advancing packaging films towards several parallel sausage stuffing horns extending in the direction of the movement of said films, longitudinally sealing said films on both sides of each of said stuffing horns to form parallel packaging film tubes having essentially the desired sausage diameter, intermittently stuffing discrete portions of sausage emulsion into each of said film tubes in such a way that the advancing film tubes become essentially stuffed with sausage emulsion along a path corresponding to the length of one sausage at a time, synchronously transversely flattening, molding and sealing, by use of a mold, the open ends of said film tubes in those areas of said film tubes which are devoid of sausage emulsion after each discrete portion of sausage emulsion is stuffed into each of said tubes to mold the rear ends of one row of sausages and the fore ends of the next row of sausages, removing the molded and sealed parallel stuffed sausage-shaped film pockets from the mold, and heating said stuffed products to cook the sausage emulsion therein to a more stable form to provide frankfurter type sausages having no other casing than the said packaging film.

2. A process according to claim 1, wherein said sausage emulsion portions ar simultaneously stuffed into about 3 to 20 connected parallel film tubes to form parallel frankfurter type sausages, and packages containing 1 to 5 successive lengths of sausages are cut from the packing film length containing the parallel individual sausages.

3. A sausage product wherein each individual sausage is enclosed in a sealed pocket of packaging films and lacks any other casing, each pocket being formed of a continuous tube of longitudinally sealed packaging films (12, 13) each tube being transversely flattened and sealed between the individual stuffed sausage lengths by a molding means molding the sausage ends, said sausages being molded by said packaging films during the production thereof and cooked within said packaging film pocket to obtain their desired stable form, said product forming a package (16) containing one or more sausages cut from a continuous length of packaging films containing said individual sausages.

4. A sausage product according to claim 3, wherein the areas between the individual sausages in said package (16) are devoid of sausage emulsion and are sealed by a molding means molding the rear end of one sausage and the fore end of the next sausage.

5. A sausage product according to claim 3 comprising a packaged product ready for sale containing one or more multiples of the length and one or more multiples of the breadth of a sausage, which package is cut from a product mat (7) of continuous lengths of packaging films (12, 13) with individually packaged sausages.

6. A sausage product according to claim 5, wherein the sausages comprise frankfurter type sausages and the package (16) includes about 3 to 20 sausages side by side and one or more sausages in succession.

7. A sausage product according to any of the claim 3 wherein said packaging film (12, 13) comprises an air impermeable, heat sealable polymer film and the pockets formed of said films are air tightly heat sealed around the sausages.

8. An apparatus for producing sausages directly into packaging films, said apparatus comprising several parallel sausage stuffing horns (1);

means (2, 3) for advancing continuous packaging films (12, 13) in the direction of said sausage stuffing horns (1) on opposite sides thereof;

means (14, 15) for continuously sealing said advancing packaging films (12, 13) longitudinally on two sides of each of said sausage stuffing horns (1) to form film tubes having essentially the diameter of a sausage;

means for stuffing discrete portions of sausage emulsion intermittently through said sausage stuffing horns (1) into said advancing film tubes; and molding means (4, 5) for synchronously transversely flattening said film tubes and sealing the packaging films together in those areas of said film tubes which are devoid of sausage emulsion after each discrete portion of sausage emulsion is stuffed into each of said film tubes to mold the rear ends of one row of sausages and the fore ends of the next row of sausages into the desired sausage end configuration, said sausage stuffing horns (1) extending in the direction of movement of said films past said longitudinally sealing means to a position adjacent to the molding means (4, 5) so that each film tube is essentially fully stuffed with sausage emulsion along a path corresponding to the length of one sausage at a time.

9. An apparatus according to claim 8 comprising about 3 to 20 parallel sausage stuffing horns (1) for stuffing frankfurter sized sausages.

10. An apparatus according to claim 8 further comprising slit cutting means (17, 18).

11. An apparatus according to claim 10, characterized in that it comprises several individual parallel stuffing horns (1), means (14, 15) for sealing the continuously advancing packaging films on two sides of each stuffing horn (1) and means for stuffing portions of sausage emulsion intermittently into each continuously advancing film tube so that each film tube is essentially filled with sausage emulsion along the path corresponding to one sausage at a time, and that said molding means (4, 5) is adapted to synchronously mold the ends of the film tubes into the desired form of the sausage ends by flattening and sealing the films together between said sausage emulsion portions at the areas of the film tubes which are devoid of sausage mass.

12. An apparatus according to claim 10 or 11, characterized in that said molding means (4, 5) is adapted at the same time to mold and seal the rear end of one sausage and the fore end of the next sausage.

13. An apparatus according to claim 11 or 12, characterized in that it comprises about 3 to 20, preferably about 5 to 10 parallel stuffing horns (1) for stuffing frankfurter sized sausages.

14. An apparatus according to claim 13, characterized in that it further comprises slit cutting means (17, 18) and/or a product film cutter (10).

15. A process according to claim 1, further comprising the step of cutting from the length of parallel individually packaged sausages, packages including one or more sausages.

16. An apparatus according to claim 8 further comprising a product film cutter (10).

17. An apparatus according to claim 10 further comprising a product film cutter (10).

18. A process according to claim 1, wherein said sausage emulsion portions are simultaneously stuffed into about 5 to 10 connected parallel film tubes to form parallel frankfurter type sausages, and packages containing 1 to 5 successive lengths of sausages are cut from the packaging film length containing the parallel individual sausages.

19. A sausage product according to claim 5, wherein the sausages comprise frankfurter type sausages and the package (16) includes about 5 to 10 sausages side by side and about 1 to 5 sausages in succession.

20. An apparatus according to claim 8 comprising about 5 to 10 parallel sausage stuffing horns (1) for stuffing frankfurter sized sausages.

* * * * *